US005447649A

United States Patent [19]

Gormsen

[11] Patent Number: 5,447,649

[45] Date of Patent: Sep. 5, 1995

[54] LIPASE CONTAINING LIQUID PRE-SPOTTER AND USE OF SUCH PRE-SPOTTER

[75] Inventor: Erik Gormsen, Kobenhavn, Denmark

[73] Assignee: Novo Nordisk A/S, Bagsvaerd, Denmark

[21] Appl. No.: 867,663

[22] PCT Filed: Feb. 28, 1992

[86] PCT No.: PCT/DK91/00058

§ 371 Date: Jul. 2, 1992

§ 102(e) Date: Jul. 2, 1992

[87] PCT Pub. No.: WO91/13141

PCT Pub. Date: Sep. 5, 1991

[30] Foreign Application Priority Data

| | | | |
|---|---|---|---|
| Mar. 1, 1990 | [DK] | Denmark | 530/90 |
| Mar. 26, 1990 | [DK] | Denmark | 772/90 |
| Jan. 24, 1991 | [DK] | Denmark | 118/91 |

[51] Int. Cl.[6] ..... C11D 3/386; C11D 3/18

[52] U.S. Cl. ..... 252/106; 252/174.12; 252/DIG. 12; 252/DIG. 14; 252/DIG. 19; 435/188; 435/198

[58] Field of Search ..... 252/174.12, DIG. 12, 252/DIG. 14, DIG. 19, 106; 435/188, 198

[56] References Cited

U.S. PATENT DOCUMENTS

| | | | |
|---|---|---|---|
| 3,557,002 | 1/1971 | McCarty | 252/89 |
| 3,741,902 | 6/1973 | Barrett | 252/90 |
| 3,950,277 | 4/1976 | Stewart et al. | 252/541 |
| 3,953,353 | 4/1976 | Barret, Jr. et al. | 252/174 |
| 4,101,457 | 6/1978 | Place et al. | 252/559 |
| 4,518,694 | 5/1985 | Shaer | 435/188 |
| 4,711,739 | 12/1987 | Kandathil | 252/139 |
| 4,801,544 | 1/1989 | Munk | 435/188 |
| 4,908,150 | 3/1990 | Hessel et al. | 252/174.12 |

FOREIGN PATENT DOCUMENTS

| | | | |
|---|---|---|---|
| 0028866 | 5/1981 | European Pat. Off. | 252/174.12 |
| 0383373 | 8/1990 | European Pat. Off. . | |
| 3003766 | 2/1979 | Germany | C11D 3/43 |
| 3223568 | 12/1983 | Germany | C11D 3/886 |
| 2042580 | 9/1980 | United Kingdom . | |

*Primary Examiner*—Paul Lieberman
*Assistant Examiner*—Kery Fries
*Attorney, Agent, or Firm*—Steve T. Zelson; Elias J. Lambiris

[57] ABSTRACT

The pre-spotter comprises a surfactant free liquid pre-spotter containing alcohol, water and an effective amount of lipase. This pre-spotter is simple and it exhibits an improved fat and oil removing effect and an improved lipase stability.

17 Claims, No Drawings

LIPASE CONTAINING LIQUID PRE-SPOTTER AND USE OF SUCH PRE-SPOTTER

The invention relates to a lipase containing liquid pre-spotter and to a use of such pre-spotter.

In relation to washing processes it is described that fat or oil stains, which are difficult to remove, can be treated with a lipase containing liquid pre-spotter, which is applied directly to the stain before the washing process. However, to the best of our knowledge no lipase containing pre-spotter is commercialized, probably due to lipase stability or performance problems. It is further described that the thus treated laundry is subsequently washed, usually at relatively low temperature, normally after a short period of time. It is one of the advantages by using a lipase containing pre-spotter that the subsequent washing process can be carried out at relatively low temperature, i.e. below around 60° C. If no lipase containing pre-spotter is used, usually the washing process will have to be carried out at around 100° C. and at high alkalinity in order to have the fat or oil stains removed effectively, but even under these conditions, i.e. at around 100° C. and at high alkalinity, some obstinate fat or oil stains cannot be removed. Reference can be made to EP 177 183, which describes special lipase containing pre-spotters in which the enzymes are encapsulated in reversed micelles. It has been found that the fat and oil removing effect of the prior art lipase containing pre-spotters and the lipase stability in the prior art lipase containing pre-spotters are open to improvement.

Thus the purpose of the invention is the provision of a simple lipase containing liquid pro-spotter, which exhibits an improved fat and oil removing effect and an improved lipase stability.

The lipase containing and surfactant free liquid pre-spotter according to the invention comprises a liquid mixture of an alcohol and water, with an alcohol content above 20% by weight, and an effective amount of lipase, whereby the balance is water. It should be noted that the pre-spotter according to the invention does not contain any surfactant, and thus exhibits a simple composition, in spite of the fact that the pre-spotter according to the invention is very effective, as demonstrated in the following examples.

In this specification with claims the term alcohol comprises both monovalent alcohols like ethanol and polyvalent alcohols (polyols) like propylene glycol. If the alcohol content is below 10% by weight, the effect and the stability of the lipase tend to be unsatisfactory.

The term "an effective amount of lipase" means an amount, which is able to remove fat and oil stains effectively, when evaluated by swatch tests described later in this specification. It is intended that all lipases can be used in the pre-spotter according to the invention. Reference can be made to Research Disclosure June 1988, No. 290, 29056.

DE patent no. 3 003 766 describes a lipase containing liquid pre-spotter which besides an alkanolamine contains at least 10% of a surfactant. This is a typical example of an aqueous, enzyme containing pre-spotter, as this kind of prior art pre-spotter all contain a surfactant. The pre-spotter according to the invention, however, is surfactant free and does not need to contain alkalolamine. The effect of the pre-spotter according to the invention is as good as or better than the known surfactant containing pre-spotter and the pro-spotter according to the invention is cheaper than the prior art pre-spotters, because the pre-spotter according to the invention does not contain the relatively expensive surfactant.

In a preferred embodiment of the pro-spotter according to the invention the pre-spotter further comprises a lipase stabilizer. Examples of suitable lipase stabilizers are $CaCl_2$ (e.g. 0.1–0.5%) or a protease inhibitor (such as borate and formate).

In a preferred embodiment of the pro-spotter according to the invention the alcohol is a mono- or polyvalent alcohol with 2–3 carbon atoms, preferably ethanol, propylene glycol, glycerol or a mixture of two or more of these. It has been found that the fat and oil removing effect is most satisfactory with these alcohols.

In a preferred embodiment of the pre-spotter according to the invention the lipase activity is at least 10,000 LU/liter of liquid pre-spotter. It has been found that the time interval between application of pre-spotter and main wash is undue long in order to obtain an efficient fat and oil removal, if the lipase activity is less than 10,000 LU/liter of liquid pre-spotter. On the other hand, for economic reasons a suitable upper limit for the lipase activity is 5,000,000 LU/liter of liquid pre-spotter.

In a preferred embodiment of the pre-spotter according to the invention the lipase is Lipolase®. It has been found that the fat and oil removal is very efficient in this embodiment.

In a preferred embodiment of the pre-spotter according to the invention the pre-spotter contains an antimicrobial agent. Examples of such agents are inorganic salts (such as NaCl), sugars (such as sucrose and glucose), organic acids (such as benzoic, sorbic, propionic, lactic and formic acids) which are generally effective in amounts of 0.01–2% at low pH (below 5). Other examples of stabilizing agents are antioxidants (such as sulphur dioxide), 1,2-benz-isothioazolin-3-one (BIT) and parabens. Some of these may also serve to improve enzyme stability.

In a preferred embodiment of the pre-spotter according to the invention the pH value is between 4 and 10, preferably between 5 and 9. In selecting the pH value for a specific pre-spotter, the stability optimum and the activity optimum of the lipase should be taken into consideration.

Also, the invention comprises a use of the pre-spotter according to the invention, and this use is characterized by the fact that the pre-spotter is applied locally to the fat or oil spots on the laundry, that the laundry is left alone for a certain time period, and that the laundry subsequently is exposed to a low temperature washing process.

The certain time period alluded to above is normally at least 5 minutes, but it can be shorter in case the lipase activity in the pre-spotter is extraordinarily high.

From the brochure Novo Detergent Enzymes B 435b-GB July 1989 it appears that very difficult stains can be removed by introduction of a pre-spotter with a Lipolase® containing detergent in a specific test, which utilized a heavy duty liquid detergent. This heavy duty liquid detergent contained around 28% surfactant.

It has been found that during the pre-spotting not exclusively a fat hydrolysis takes place but additionally an ester synthesis based on the alcohol in the pre-spotter and the fatty acids liberated from the fat or oil stains by means of the lipolytically catalyzed hydrolysis. It is surprising that an ester synthesis takes place because of the high water activity. Also, the ester formed by the above indicated ester synthesis performs as a surfactant, improving the fat and oil removing effect. Thus, it is assumed that part of the improved fat and oil removing effect of the pre-spotter according to the invention has to be ascribed to this ester synthesis; however, applicant does not want to be bound to this hypothesis.

In the examples shown below the lipase activity is measured in LU lipase activity units. The LU activity determination method is based on hydrolysis of tributyrin in a pH-stat. 1 LU (lipase Unit) is the amount of enzyme which liberates 1 μmole titratable butyric acid per minute at 30° C. and pH 7.0 with gum arabic as an emulsifier. Further details are given in Novo Nordisk analytical Method AF 95/5, available on request from Novo Nordisk A/S, Novo Allé, DK-2880 Bagsvaerd, Denmark.

In the examples shown below the following general procedure was used.

Method: Embodiments of liquid pre-spotter were applied to the fat stain on a test swatch by means of a pipette. The amount of pre-spotter used depended on the size of the stain and on the kind of fabric; typically 0.5–3 ml of prespotter was satisfactory. After 5–30 minutes of incubation the swatches are washed in a Laboratory washing machine (Launder-o-meter or Terg-o-tometer) at low temperature (20°–40° C.). The detergent used in the washing process was a standard powder or liquid detergent.

Swatches: The swatches were made from colored (e.g. blue or green) cotton fabric. The fabric was cut into test pieces with the dimensions 12×12 cm, and 75–150 μl of fatty material (e.g. lard, margarine, butter, or olive oil) was applied to the center of each swatch. The amount of fatty material applied depended on the type of fatty material used. The fatty material was heated to approx. 70° C. before application in order to facilitate the penetration of fatty material into the fabric. The stained fabric was aged at room temperature for 1 day before treatment.

Evaluation: After washing and drying the swatches were gently ironed. The swatches were visually inspected and compared to reference swatches which had been identically treated but without any lipase added to the pre-spotter formulation. In order to quantify the efficiency of the lipase, extraction of the residual fatty material can be carried out (Soxhlet, chloroform, 5 hours).

EXAMPLE 1

Effect of Lipolase® in pre-spotter formulations based on water and propylene glycol Stain: Lard on green cotton sheet.

75 μl of lard was applied on each swatch. After stain application, the swatches were heat treated in an oven for 30 minutes at 75° C. in order to obtain a better distribution of the stain.

Prespotting: 1 ml of pre-spotter was applied with a pipette to the center of the stains and subsequently the swatches were incubated for 15 minutes at room temperature.

The pre-spotter formulations contained 1% Lipolase® 100 L (100,000 LU/g) and 99% (w/w) of a mixture of water and propylene glycol. Accordingly the lipase activity in the pre-spotters was 1000 LU/g. For comparison, the same pre-spotter formulations, but without added lipase, were evaluated as well.

Washing: Immediately after pre-spotting the swatches were washed in a Terg-o-tometer (40° C., 20 minutes, 18° dH, pH 9.5) with a simplified European powder detergent containing 1.75 g/l of sodium triphosphate, 0.40 g/l of sodium metasilicate, 2.00 g/l of sodium sulphate, 0.30 g/l of Berol 160 (alcohol ethoxylate from Berol Kemi AB, Sweden), and 0.50 g/l of Nansa S80/S (LAS from Albright & Wilson, UK).

Evaluation: A trained test panel (13 persons) evaluated the stain removal by visual inspection.

Def. of score:

0 Heavy stain (=untreated stain)
1 Clearly visible stain
2 Visible stain
3 Hardly visible stain
4 Mere trace of stain
5 Stain completely removed Results: The mean score of the investigated pre-spotter formulation were as follows:

| Water % w/w | Propylene glycol % w/w | Pre-spotter without Lipolase® | Pre-spotter with 1% Lipolase® 100 L |
|---|---|---|---|
| 100 | 0 | 1.3 | 3.3 |
| 90 | 10 | 1.2 | 3.1 |
| 80 | 20 | 1.0 | 3.9 |
| 70 | 30 | 1.0 | 4.0 |
| 60 | 40 | 1.5 | 4.0 |
| 50 | 50 | 1.1 | 3.8 |
| 40 | 60 | 1.1 | 4.2 |
| 30 | 70 | 1.2 | 4.6 |
| 20 | 80 | 1.3 | 4.4 |
| 10 | 90 | 1.2 | 4.4 |
| 0 | 100 | 1.3 | 2.9 |

EXAMPLE 2

Effect of lipase dosage in a pre-spotter formulation based on water and propylene glycol The same kind of test material and the same pre-spotting, washing, and evaluation method as described in Example 1 was used; the only difference being that the dosage of Lipolase® 100 L was varied between 0 and 5%.

Results (mean score of test panel evaluation):

| Pre-spotter formulation % w/w | | | | | | |
|---|---|---|---|---|---|---|
| Water % w/w | Propylene glycol % w/w | Lipolase® 100 L (% w/w) | | | | |
| | | 0 | 0.5 | 1.0 | 2.0 | 5.0 |
| 25–30 | 70 | 1.3 | 1.8 | 2.8 | 3.4 | 4.9 |

EXAMPLE 3

Effect of different lipases in pre-spotter formulations based on water and propylene glycol The same experiments as described in Example 2 were carried out, the only difference being that four lipases of different origin (2 fungal, 1 bacterial and 1 from yeast) were investigated. The lipases were compared on an LU-activity basis.

Results (mean score of test panel evaluation):

| Lipase | Pre-spotter formulation % w/w: Water % w/w | Propylene glycol % w/w | Lipase dosage LU/g: 0 | 1000 | 5000 |
|---|---|---|---|---|---|
| Lipolase ® | 35 | 65 | 1.0 | 3.5 | 4.6 |
| *Mucor miehei*[1)] | 35 | 65 | 1.0 | 2.8 | 4.8 |
| *Pseudomonas cepacia*[2)] | 35 | 65 | 1.0 | 5.0 | 5.0 |
| *Candida cylindracea*[3)] | 35 | 65 | 1.0 | 3.6 | — |

[1)]see Huge-Jensen et al. (1989), Lipids 24, 781–785
[2)]see EP 0214761
[3)]Sigma L1754

EXAMPLE 4

Effect of Lipolase ® in pre-spotter formulations containing different alcohols The same kind of test material and the same pre-spotting washing, and evaluation method as described in Example 1 was used.

Results (mean score of test panel evaluation):

| Alcohol | Pre-spotter formulation: water % w/w | Alcohol % w/w | Pre-spotter without enzyme | Pre-spotter with 1% Lipolase ® 100 L |
|---|---|---|---|---|
| Ethanol | 65 | 35 | 1.3 | 4.0 |
| | 35 | 65 | 1.2 | 4.0 |
| 1-propanol | 65 | 35 | 1.4 | 2.8 |
| | 35 | 65 | 1.2 | 2.7 |
| 2-propanol | 65 | 35 | 1.1 | 3.4 |
| | 35 | 65 | 1.2 | 4.2 |
| Ethylene | 65 | 35 | 1.1 | 3.7 |
| glycol | 35 | 65 | 1.2 | 3.8 |
| Propylene | 65 | 35 | 1.3 | 3.2 |
| glycol | 35 | 65 | 1.4 | 4.1 |
| Glycerol | 65 | 35 | 0.8 | 3.3 |
| | 35 | 65 | 0.8 | 3.7 |

EXAMPLE 5

Effect of Lipolase ® in water/propylene glycol formulation

Stain: 3 different stains were investigated

1) Upstick on white cotton (interlock type). The lipstick was applied directly onto the fabric in a homogenous layer (diameter of the spot: 40 mm)
2) Lard on purple cotton (interlock type). 150 μl of lard per swatch.
3) Olive oil on dark green cotton (interlock type). 150 μl of olive oil per swatch.

Pre-spotting: 3 ml of pre-spotter was applied to the center of the stains and subsequently the swatches were incubated for 15 minutes at room temperature.

The pre-spotter formulation contained 5% (w/w) Lipolase ® 100 L, 45% (w/w) water, and 50% (w/w) propylene glycol. Accordingly the lipase activity in the pre-spotter was 5000 LU/g.

For comparison, the same pre-spotter formulation, but without added lipase, i.e. 50% w/w water and 50% w/w propylene glycol, were evaluated as well.

Washing: Immediately after pre-spotting the swatches were washed in a Terg-o-tometer (30° C., 30 minutes, 18° dH, pH 9.5) with a commercial European powder detergent (5 g/l).

Evaluation: The performance of the pre-spotter was evaluated by the same test panel method as described in Example 1.

Results: The mean scores (12 persons) were as follows:

| Stain | Pre-spotter without Lipolase ® | Pre-spotter with 5% Lipolase ® 100 L |
|---|---|---|
| Lipstick | 1.3 | 3.2 |
| Lard | 1.2 | 4.8 |
| Olive oil | 1.7 | 4.9 |

EXAMPLE 6

Storage stability of pre-spotter formulations

The enzymatic stability of Lipolase ® was investigated in 5 different pre-spotter formulations.

| % w/w | 1 | 2 | 3 | 4 | 5 |
|---|---|---|---|---|---|
| Lipolase ® 100 L | 2 | 2 | 2 | 2 | 2 |
| Deionized water | 38 | 28 | 48 | 38 | 58 |
| Propylene glycol | 60 | 70 | 50 | — | — |
| Glycerol | — | — | — | 60 | 40 |
| pH | 7.5 | 7.6 | 7.6 | 7.5 | 7.4 |

The pre-spotter formulations were stored at 30° C. in closed bottles and the activity was followed over a 2 months period.

| Storage (days) | Pre-spotter formulations Residual activity (%): 1 | 2 | 3 | 4 | 5 |
|---|---|---|---|---|---|
| 0 | 100 | 100 | 100 | 100 | 100 |
| 4 | 107 | 104 | 108 | 108 | 95 |
| 19 | 118 | 111 | 110 | 112 | — |
| 63 | 113 | 104 | 105 | 107 | 97 |

EXAMPLE 7

Synthesis of esters vs hydrolysis under pre-spotting conditions

In order to investigate lipase catalyzed formation of esters vs hydrolysis the following experiment was carried out. Olive oil adsorbed to PVC particles was incubated in pre-spotting formulations containing a lipase. After 5 minutes of incubation the reaction was stopped and fatty matter was extracted and analyzed by chromatography. Conditions of incubation: 30° C., pH 7.0, 0.33 g olive oil adsorbed on 1.67 g PVC powder, 20 g pre-spotter, 1500 LU.

Results:

| Alcohol | Pre-spotter formulation: water % w/w | Alcohol % w/w | Free fatty acids μmoles | Fatty acid esters of the alcohol, μmoles |
|---|---|---|---|---|
| none | 100 | 0 | 34 | 0 |
| methanol | 80.5 | 19.5 | 138 | 186 |
| | 65.9 | 34.1 | 106 | 240 |
| | 36.6 | 63.4 | 92 | 309 |
| ethanol | 80.5 | 19.5 | 92 | 74 |
| | 65.9 | 34.1 | 52 | 62 |
| | 36.6 | 63.4 | 111 | 211 |
| ethylene | 80.5 | 19.5 | 80 | 0 |
| glycol | 65.9 | 34.1 | 97 | 16 |
| | 36.6 | 63.4 | 94 | 77 |

-continued

| Alcohol | Pre-spotter formulation water % w/w | Pre-spotter formulation Alcohol % w/w | Free fatty acids μmoles | Fatty acid esters of the alcohol, μmoles |
|---|---|---|---|---|
| propylene | 65.9 | 34.1 | 130 | 24 |
| glycol | 36.6 | 63.4 | 83 | 49 |

I claim:

1. A prespotter composition comprising (a) an effective amount of an enzyme component which consists essentially of a lipase enzyme and (b) a liquid mixture consisting of (i) an alcohol in an amount of above 20% by weight of the composition and (ii) water, wherein the prespotter composition does not contain a surfactant.

2. The prespotter composition according to claim 1, further comprising a lipase stabilizer.

3. The prespotter composition according to claim 2, wherein the lipase stabilizer is selected from the group consisting of $CaCl_2$, borate and formate.

4. The prespotter composition according to claim 1, wherein the alcohol is selected from the group consisting of ethanol, propylene glycol, glycerol and mixtures thereof.

5. The prespotter composition according to claim 1, wherein the lipase activity is at least 10,000 LU/liter of the prespotter composition.

6. The prespotter composition according to claim 1, further comprising an antimicrobial agent.

7. The prespotter composition according to claim 6, wherein the antimicrobial agent is selected from the group consisting of NaCl, sucrose, glucose, benzoic acid, propionic acid, lactic acid, formic acid, sulphur dioxide, 1,2-benz-isothioazolin-3-one and parbens.

8. The prespotter composition according to claim 1 having a pH between 4 and 10.

9. The prespotter composition according to claim 8 having a pH between 5 and 9.

10. A method for removing a fat or oil stain from a fabric, comprising (a) applying a prespotter composition according to claim 1 to the fat or oil stain, (c) incubating the fabric for a sufficient amount of time, and (c) washing the fabric at a temperature between 20° and 40° C.

11. The method according to claim 10, wherein the prespotter composition further comprises a lipase stabilizer.

12. The method according to claim 11, wherein the lipase stabilizer is selected from the group consisting of $CaCl_2$, borate and formate.

13. The method according to claim 10, wherein the alcohol is selected from the group consisting of ethanol, propylene glycol, glycerol and mixtures thereof.

14. The method according to claim 10, wherein the lipase activity is at least 10,000 LU/liter of the prespotter composition.

15. The method according to claim 10, wherein the prespotter composition further comprises an antimicrobial agent.

16. The method according to claim 15, wherein the antimicrobial agent is selected from the group consisting of NaCl, sucrose, glucose, benzoic acid, propionic acid, lactic acid, formic acid, sulphur dioxide, 1,2-benz-isothioazolin-3-one and parbens.

17. The method according to claim 10, wherein the pH of the prespotter composition is between 4 and 10.

* * * * *